US007779800B2

(12) United States Patent
Methley et al.

(10) Patent No.: US 7,779,800 B2
(45) Date of Patent: Aug. 24, 2010

(54) VANE-TYPE PHASER

(75) Inventors: Ian Methley, Witney (GB); Jonathan Alexander Aspinall, Kidlington (GB)

(73) Assignee: Mechadyne PLC, Kirtlington (GB)

( * ) Notice: Subject to any disclaimer, the term of this patent is extended or adjusted under 35 U.S.C. 154(b) by 483 days.

(21) Appl. No.: 11/721,958

(22) PCT Filed: Nov. 8, 2005

(86) PCT No.: PCT/GB2005/050199

§ 371 (c)(1),
(2), (4) Date: Jun. 15, 2007

(87) PCT Pub. No.: WO2006/067519

PCT Pub. Date: Jun. 29, 2006

(65) Prior Publication Data

US 2009/0272349 A1 Nov. 5, 2009

(30) Foreign Application Priority Data

Dec. 23, 2004 (GB) ..... 0428063.2

(51) Int. Cl.
*F01L 1/34* (2006.01)

(52) U.S. Cl. ..... 123/90.17; 123/90.15; 123/90.31

(58) Field of Classification Search ..... 92/120, 92/121, 122, 123, 124, 125; 123/90.17, 90.18, 123/90.15, 90.31
See application file for complete search history.

(56) References Cited

U.S. PATENT DOCUMENTS

| | | | | |
|---|---|---|---|---|
| 4,091,776 | A | 5/1978 | Clemens et al. | |
| 6,336,433 | B1 | 1/2002 | Anton et al. | |
| 6,481,401 | B1 * | 11/2002 | Schafer | 123/90.17 |
| 6,669,567 | B1 | 12/2003 | Scheidt et al. | |
| 6,725,817 | B2 * | 4/2004 | Methley et al. | 123/90.17 |
| 6,827,052 | B2 * | 12/2004 | Kobayashi et al. | 123/90.17 |
| 6,948,467 | B2 * | 9/2005 | Lipke et al. | 123/90.17 |
| 2001/0017116 | A1 | 8/2001 | Eguchi | |

FOREIGN PATENT DOCUMENTS

| | | |
|---|---|---|
| EP | 0799976 | 10/1997 |
| EP | 0807747 | 11/1997 |
| GB | 2369175 | 5/2002 |

* cited by examiner

*Primary Examiner*—Zelalem Eshete
(74) *Attorney, Agent, or Firm*—Chernoff, Vilhauer, McClung & Stenzel

(57) ABSTRACT

A vane-type phaser connected to drive an assembled camshaft includes a drive member and a driven member each connected to a respective one of the inner and outer shafts of the camshaft. A first of the members includes a disc with at least one arcuate cavity that is open at both axial ends. The second member includes two closure plates sealing off the axial ends of each cavity of the first member and at least one vane formed separately from the closure plates which is movably received in a respective cavity to divide the cavity into two variable volume working chambers. Each vane is secured at both its axial ends to the two closure plates.

8 Claims, 3 Drawing Sheets

VANE-TYPE PHASER

CROSS-REFERENCE TO RELATED APPLICATION

This is a national stage application filed under 35 USC 371 based on International Application No. PCT/GB2005/050199 filed Nov. 8, 2005, and claims priority under 35 USC 119 of United Kingdom Patent Application No. 0428063.2 filed Dec. 23, 2004.

FIELD OF THE INVENTION

The present invention relates to a vane-type phaser in combination with an assembled camshaft for enabling the phase of rotation of engine cams to be varied in relation to the phase of rotation of the engine crankshaft.

BACKGROUND OF THE INVENTION

A phaser, also termed a phase change mechanism, is a device used in engines to vary dynamically the instant, or phase angle, in the engine cycle when the intake and/or exhaust valves of the engine open and close. Such devices are known which are incorporated in the drive pulley of the camshaft and which comprise a drive member connected to the camshaft and a driven member connected to the crankshaft. The drive member normally rotates with and at the same speed as the driven member but when it is desired to change the phase of the camshaft, the two members are rotated relative to one another.

In a vane-type phaser, as described for example in EP 0799976, EP 0807747 and GB 2369175, the rotation of the drive member relative to the driven member is effected hydraulically. A vane movable with one of the two members is received in an arcuate cavity of the other member and divides the cavity into two variable volume working chambers. When a hydraulic pressure medium, usually engine oil, is prevented from entering into or being discharged from the working chambers, the drive and driven members rotate as one. On the other hand, when pressure medium is pumped into one chamber and discharged from the other, the members are rotated relative to one another to change the phase of the camshaft relative to the crankshaft.

SUMMARY OF THE INVENTION

According to the present invention, there is provided in combination, a camshaft assembly comprising a tubular first shaft, a second shaft arranged concentrically within the first shaft and rotatable relative thereto, and cams mounted for rotation with the first and second shafts whereby relative rotation of the first and second shafts causes selected cams of the camshaft to rotate relative to other cams of the camshaft, and a phaser comprising a drive member and a driven member each connected for rotation with a respective one of the two shafts of the camshaft assembly, wherein a first of the drive and driven members comprises a disc with at least one arcuate cavity that is open at both axial ends, and a second of the drive and driven members comprises two closure plates sealing off the axial ends of each cavity of the first member, and wherein the phaser further comprises at least one vane formed separately from the closure plates which is movably received in a respective cavity to divide the cavity into two variable volume working chambers, each axial end of the vane being secured to a respective one of the two closure plates.

The combination of the invention is advantageous in that it eliminates any variation in the clearance between the vane and the cavity as a result of relative axial movement of the two members. Furthermore, the phaser simplifies assembly and reduces the number of components that need to be manufactured with close tolerances. In this respect, it is only necessary to ensure that axial length of the vanes matches the thickness of the disc in which the cavity is formed. As the vanes are secured at their opposite ends to the two closure plates, leakage at the axial ends of the vanes is entirely avoided and seals fitted to the radially inner and outer sides of the vanes can readily ensure an adequate seal between the vanes and the cavity walls. The large area of overlap between the closure plates and the axial end surfaces of the disc also minimises any leakage from between the two members.

In a preferred embodiment of the invention, the first member may be formed with a central bore having formations for coupling the first member for rotation with a tubular shaft. In this case, it is possible to form one of the closure plates with a central bore of a diameter at least equal to that of central bore of the first member and the other closure plate with a central bore of smaller diameter than the bore of the first member. This enables the second closure plate to be secured by means of an axially extending fastener to the axial end of a second shaft passing through the central bores of the first closure plate and the first member.

Alternatively, the first closure plate may have formations for coupling the second member for rotation with a tubular shaft. In this case, the first member can be formed with a bore smaller than that of the first closure plate. This enables the first member to be secured by means of an axially extending fastener to the axial end of a second shaft passing through the central bore of the first closure plate. The head of the fastener could be accessed through a clearance bore in the second closure plate.

In a hydraulically operated phaser, the phase of the camshaft cannot be controlled by the phaser until the available hydraulic pressure, for example from the engine lubricant pump, is sufficient to overcome the reaction forces acting on the valve train. It is therefore further desirable for the phaser to comprise a locking pin disposed within the first member and spring biased to engage in a hole in the second member to lock the two members in a predetermined position relative to one another, the pin being retractable by the hydraulic pressure prevailing in the working chambers whereby the locking pin is automatically retracted to permit relative angular movement of the two members when the hydraulic pressure in the working chamber is sufficient to rotate the members relative to one another.

BRIEF DESCRIPTION OF THE DRAWINGS

The invention will now be described further, by way of example, with reference to the accompanying drawings, in which.

DETAILED DESCRIPTION OF THE PREFERRED EMBODIMENT

Figure 1:
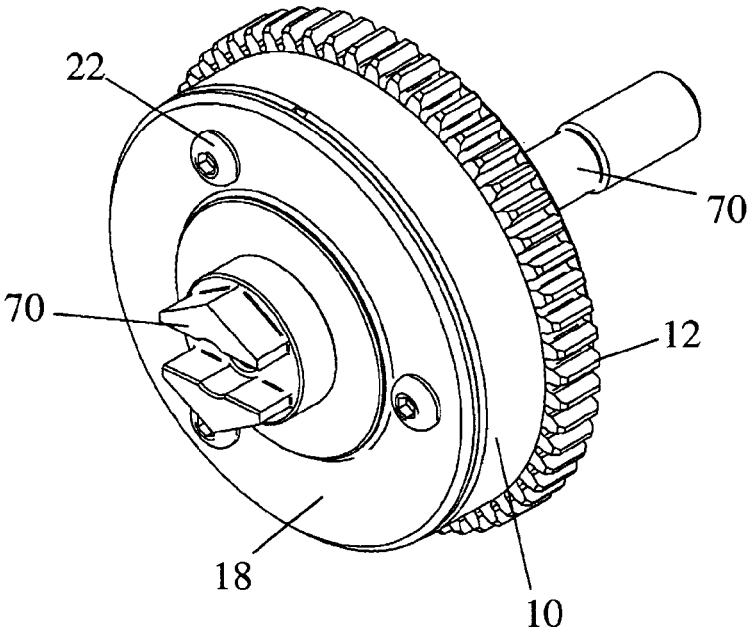
FIG. 1 is a perspective view of an assembled phaser of the invention.
Figure 2:
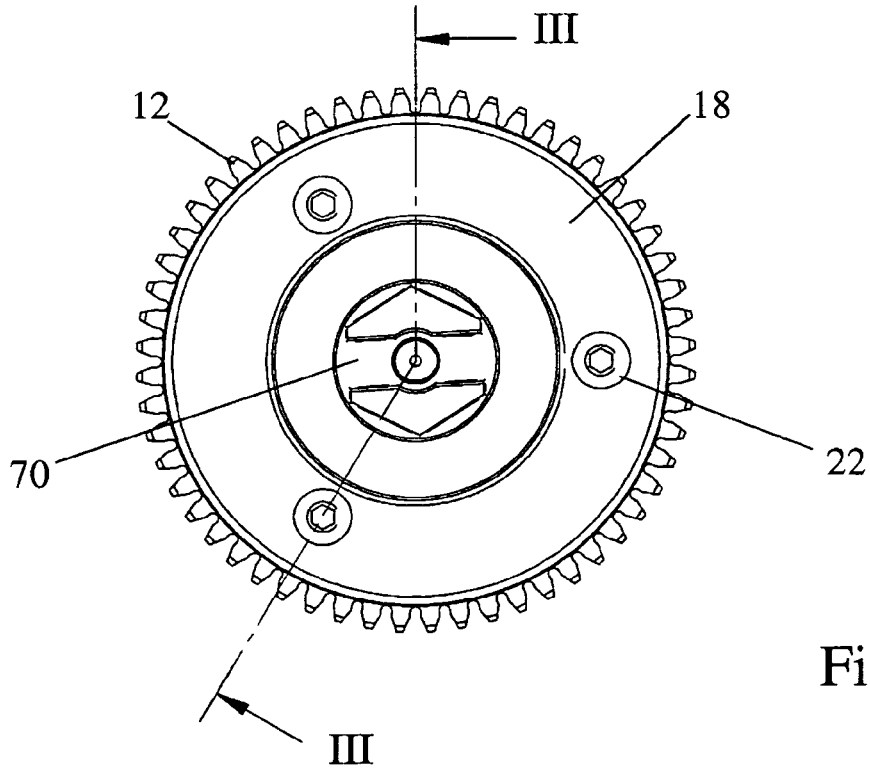
FIG. 2 is a front view of the phaser in FIG. 1.

The phaser in the drawings comprises a driven member 10 which is in the form of a thick disc with gear teeth 12. The gear teeth 12 mesh with a gear or a toothed belt (not shown) driven by the engine crankshaft to rotate the camshaft at half the engine speed (in the case of a four-stroke engine). The phaser is intended to replace the drive pulley that would normally be mounted on the front end of a camshaft.

The disc 10 has three arcuate through cavities 14 each of which receives a respective radial vane 16. The vanes 16 are secured to two closure plates 18 and 20 which cover the axial ends of the cavities 14 to form within each cavity two closed hydraulic working chambers separated from one another by a movable wall constituted by the vane 16. The vanes 16 are axially clamped between the closure plates 18 and 20 by means of bolts 22 and nuts 24. To prevent the vanes from rotating about the axis of the bolt 22, an alignment pin 26 projects from the end of each vane 16 into a hole 28 in the end plate 20.

Figure 4:
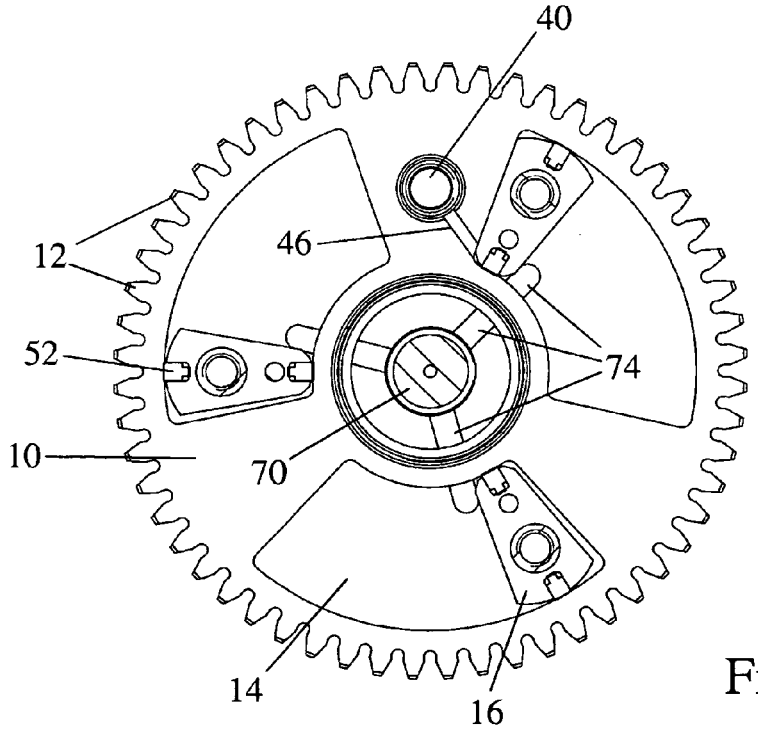
FIG. 4 is a section along the line IV-IV in FIG. 3.

The axial length of the vanes 16 is machined to within a close tolerance to match the axial thickness of the disc 10. As a result, the flat faces of the closure plates 18 and 20 seal off the cavities 14 from one another while still allowing the vanes 16 to rotate within the cavities 14. The closure plates 18 and 20 constitute the drive member that is coupled to rotate the camshaft in a manner to be described in greater detail below. The two radial tips of each vane 16 receive seals 52, as shown in FIG. 4, so that oil cannot flow between the working chambers past the vanes 16. Therefore, by supplying engine oil to the working chambers on the opposite sides of the vanes 16, the drive and driven members can be rotated relative to one another to vary the phase of the camshaft relative to the crankshaft.

Figure 3:
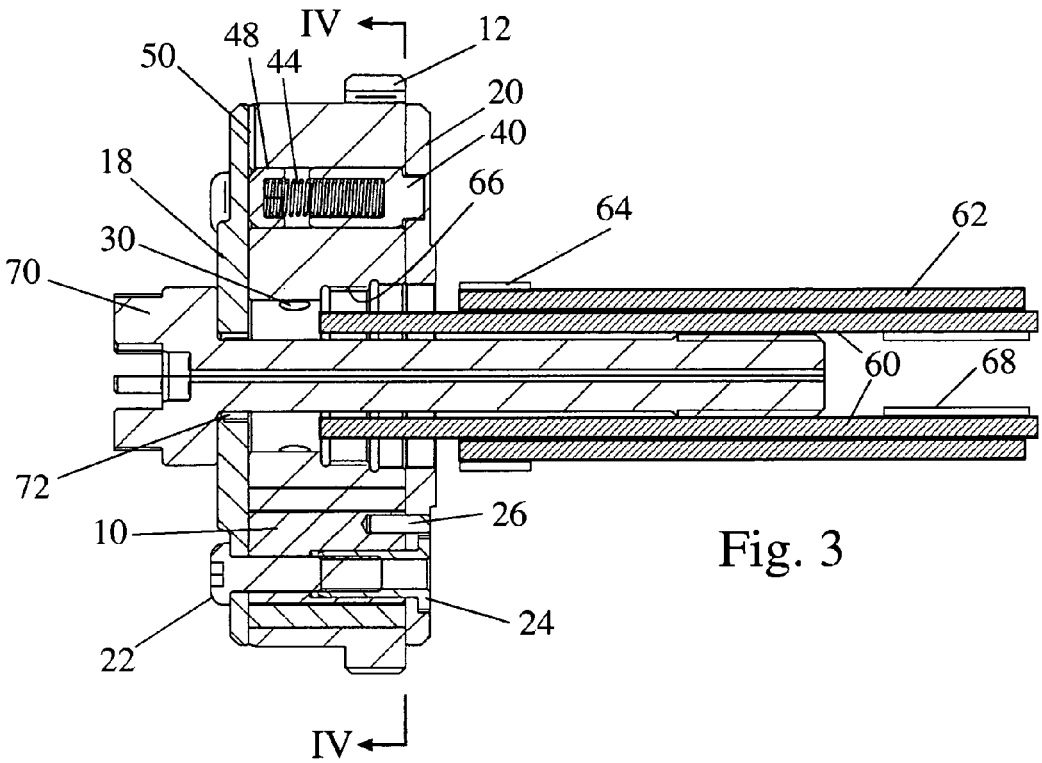
FIG. 3 is a section along the line III-III in FIG. 2.

A locking pin 40, which is received in an axially extending bore 42 in the disc 10, projects, as shown in FIG. 3, into a blind bore in the closure plate 20 under the action of a spring 44. The pin 40 serves to lock the drive and driven members for rotation with one another when the oil pressure is too low to overcome the resistance of the valve train. When the oil pressure rises, oil supplied to the right hand side of the locking pin 40, as viewed in FIG. 3, retracts the pin 40 into the bore 42. The oil is supplied through a radial passage 46 (see FIG. 4) in the disc 10 connecting the bore 42 to one of the cavities. Air behind the pin 42 is expelled past an end cap 48. For this purpose, the end cap 48 has a flat and the space behind it has a radial vent passage 50.

The illustrated phaser is fitted to a two-part camshaft shown schematically in FIG. 3 as comprising an inner shaft 60 and a tubular outer shaft 62. The outer shaft 62 has a threaded end 64 engageable with an internal screw thread 66 formed in the disc 10. The inner shaft 60 on the other hand has an internal thread 68 that is engaged by the thread of a bolt 70 that passes through an axial bore 72 in the closure plate 18 and acts the clamp the closure plate 18 against the axial end of the shaft 60. In this way the shaft 62 rotates with the driven member 10 and the shaft 60 rotates with the drive member that includes the closure plates 18 and 20. Each of the shafts 60 and 62 is fast in rotation with a different group of cams so that the phaser will act to alter the phase of some cams relative to the crankshaft while other cams are always rotated in the same phase relative to the crankshaft.

Figure 5:
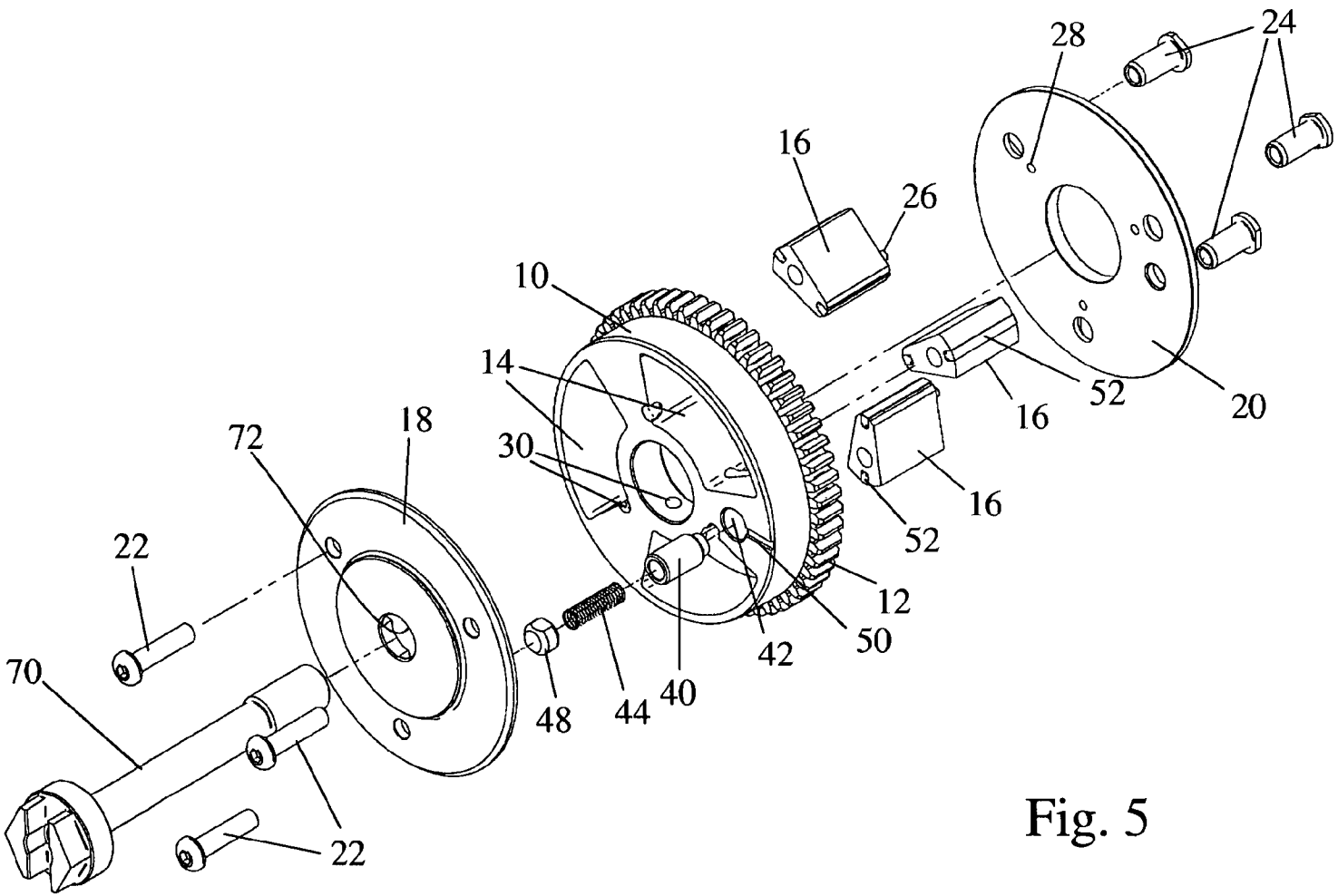
FIG. 5 is an exploded perspective view of the phaser of FIGS. 1 to 4.

To effect a phase change, oil is supplied to the different working chambers through passages in the camshaft (not shown). One passage in the camshaft communicates with angled bores 30 in the disc 10, shown in FIGS. 3 and 5, that lead to the working chambers on one side of the vanes 16. The working chambers on the opposite sides of the vanes 16 communicate through radial grooves 74 formed in the closure plate 18 with a small cavity defined by the annulus of the axial bore 72 that surrounds the bolt 70.

An important advantage presented by the illustrated phaser is that the disc 10 is firmly located between the two closure plates 18 and 20 and cannot move axially relative to them. The clearance between the drive and driven members is therefore fixed and does not vary with the axial loading on the phaser. Furthermore, only few surfaces need to be manufactured to exacting standards, thereby offering a considerable cost saving. The fact that the design of the phaser offers convenient locations to establish a coupling between the camshaft and both the drive and the driven members of the phaser makes it particularly suitable for two-part camshafts, as described.

The invention claimed is:

1. In combination, a camshaft assembly comprising a tubular first shaft, a second shaft arranged concentrically within the first shaft and rotatable relative thereto, and cams mounted for rotation with the first and second shafts whereby relative rotation of the first and second shafts causes selected cams of the camshaft to rotate relative to other cams of the camshaft, and a phaser comprising a drive member and a driven member each connected for rotation with a respective one of the two shafts of the camshaft assembly, wherein a first of the drive and driven members comprises a disc with at least one arcuate cavity that is open at both axial ends, and a second of the drive and driven members comprises two closure plates sealing off the axial ends of each cavity of the first member, and wherein the phaser further comprises at least one vane which is movably received in a respective cavity to divide the cavity into two variable volume working chambers, the vane having two opposite axial ends secured to the two closure plates respectively.

2. The combination of claim 1, wherein the first member is formed with a central bore having formations for coupling the first member for rotation with a shaft.

3. The combination of claim 2, wherein one of the closure plates is formed with a central bore of a diameter at least equal to that of central bore of the first member and the other closure plate is formed with a central bore of smaller diameter than the bore of the first member so as to enable the second closure plate to be secured by means of an axially extending fastener to the axial end of a shaft passing through the central bores of the first closure plate and the first member.

4. The combination of claim 3, wherein the first member is formed with a central bore of smaller diameter than the bore of at least one of the closure plates so as to enable the first member to be secured by means of an axially extending fastener to the axial end of a shaft passing through the central bores of the first closure plate.

5. The combination of claim 1, wherein one of the closure plates is formed with a central bore having formations for coupling the second member for rotation with a shaft.

6. The combination of claim 1, further comprising a locking pin disposed within the first member and spring biased to engage in a hole in the second member to lock the two members in a predetermined position relative to one another, the pin being retractable by the hydraulic pressure prevailing in the working chambers whereby the locking pin is automatically retracted to permit relative angular movement of the two members when the hydraulic pressure in the working chamber is sufficient to rotate the members relative to one another.

7. The combination of claim 1, wherein the second shaft of the camshaft is coupled for rotation with the first member of the phaser and the first shaft is coupled for rotation with the second member.

8. The combination of claim 1, wherein the second shaft of the camshaft is coupled for rotation with the second member of the phaser and the first shaft is coupled for rotation with the first member.

* * * * *